US006035867A

United States Patent [19]

Barrick

[11] Patent Number: 6,035,867

[45] Date of Patent: Mar. 14, 2000

[54] LIP COLOR SAMPLING SCREEN

[76] Inventor: Judith I. Barrick, 8904 Gallant Green Dr., McLean, Va. 22102-1515

[21] Appl. No.: 09/264,021

[22] Filed: Mar. 8, 1999

Related U.S. Application Data

[60] Provisional application No. 60/077,396, Mar. 16, 1998, provisional application No. 60/085,026, May 11, 1998, and provisional application No. 60/087,420, Jun. 1, 1998.

[51] Int. Cl.[7] ..... A45D 40/26

[52] U.S. Cl. ..... 132/320; 132/319; 206/823; 221/25

[58] Field of Search ..... 132/314, 319, 132/320, 333, 294, 200; 206/581, 823, 368; 221/25, 27, 69, 70

[56] References Cited

U.S. PATENT DOCUMENTS

| | | | |
|---|---|---|---|
| 2,511,557 | 6/1950 | Arnold . | |
| 4,471,874 | 9/1984 | Morane . | |
| 4,611,611 | 9/1986 | Beal, Jr. | 132/320 |
| 4,725,495 | 2/1988 | Garbe et al. . | |
| 4,747,782 | 5/1988 | Campbell, Jr. . | |
| 4,751,934 | 6/1988 | Moir et al. . | |
| 4,824,143 | 4/1989 | Grainger . | |
| 4,876,136 | 10/1989 | Chang et al. | 132/320 |
| 4,884,719 | 12/1989 | Levine et al. | 221/25 |
| 4,915,234 | 4/1990 | Boeller . | |
| 4,925,667 | 5/1990 | Fellows et al. . | |
| 4,995,408 | 2/1991 | Wallschlaeger | 132/320 |
| 5,000,202 | 3/1991 | Stepan . | |
| 5,037,139 | 8/1991 | Schoenleber et al. . | |
| 5,069,232 | 12/1991 | Staar . | |
| 5,072,831 | 12/1991 | Parrotta et al. . | |
| 5,109,879 | 5/1992 | Seidler . | |
| 5,163,581 | 11/1992 | Lombardi, Jr. | 132/320 |
| 5,221,153 | 6/1993 | Spatz . | |
| 5,337,897 | 8/1994 | Yablans . | |
| 5,538,022 | 7/1996 | Bennett . | |
| 5,562,112 | 10/1996 | Gunderman et al. | 132/333 |
| 5,647,941 | 7/1997 | Gunderman et al. . | |
| 5,690,130 | 11/1997 | Gunderman et al. . | |

OTHER PUBLICATIONS

Paula Allen, "Swapping The Art of the Deal," Your Beauty and Health Guide at The Mining Company.com, Nov. 18, 1997.

Angela Babin, M.S. and Karen Giacalone, "Shared Theatrical Makeup," Data sheet published by The Center for Safety in the Arts, 1988.

Cornell News release, "Cornell stident hosptialized with suspected meningococcemia," Ithica, NY, Feb. 1, 1996.

Dori Stehlin, "Cosmetic Safety: More Complex Than at First Blush," FDA Consumer Nov. 1991, rev. May 1995.

*Primary Examiner*—Gene Mancene
*Assistant Examiner*—Pedro Philogene
*Attorney, Agent, or Firm*—James Creighton Wray; Meera P. Narasimhan

[57] ABSTRACT

Transparent plastic strips are dispensed one at a time for use in sampling cosmetics. Each strip has a facial feature outline, preferably lips, embossed, etched or printed on the strip for receiving colored cosmetic, preferably lip color, within the outline. The strips have extensions extending outward from the outline for grasping and holding the strips in front of the facial feature of the user, usually lips, to determine which cosmetic color or lip color, shade and gloss best suits the user's face and satisfies the user. The transparent plastic strips are disposable and are used to promote sales of cosmetics by encouraging sampling of multiple colors and shades. The transparent strips are disposable after use by a customer to provide sanitary conditions for the users and for the cosmetics available for sampling at a cosmetic counter. The transparent plastic strips may be blank. The plastic strip is then placed on a template that has a lip depiction. An outline is formed on the plastic strip using the lip depiction on the template as a guide before applying make up within the outline.

23 Claims, 4 Drawing Sheets

LIP COLOR SAMPLING SCREEN

This application claims the benefit of U.S. Provisional Applications 60/077,396, filed Mar. 16, 1998, 60/085,026 filed May 11, 1998 and 60/087,420 filed Jun. 1, 1998.

BACKGROUND OF THE INVENTION

Consumers often prefer to sample lip color and other cosmetics by applying the product, in order to visualize how the particular color and other characteristics look on themselves. In fact, at cosmetic counters and other sales outlets, there is no other method to see how a lip color appears on one's own lips, However, direct application of lip color samples to the consumer's lips bears the risk of transmitting disease-causing bacteria or viruses as the samples have usually been used by other consumers. It is not practical or cost effective to use a previously unused lipstick for each consumer's sampling.

The use of shared makeup counter samples and applicators of eye makeup can be a source of disease transmission. The Food & Drug Administration has six principal suggestions for makeup safety. The most succinctly stated one is simply, "Never share."

The FDA and others have warned that sharing of lip color and other make-up products can transmit disease. Bacteria has been shown to be present on used lip color material.

Another problem with the applying lip color directly to one's lips is that testing a plurality of different colors requires that the consumer's lips be wiped clean between each different application. This cleansing operation is difficult and cumbersome in a store setting, and irritates the lips as well.

The new invention is an improvement over the lip color or cosmetic samplers of Gunderman et al., (U.S. Pat. Nos. 5,647,941 and 5,562,112), Parrotta, et al. (U.S. Pat. No. 5,072,831), Schoenleber, et al. (U.S. Pat. No. 5,037,139), Stepan (U.S. Pat. No. 5,000,202), Wallschlaeger (U.S. Pat. No. 4,995,408), Fellows, et al. (U.S. Pat. No. 4,925,667), Levine, et al. (U.S. Pat. No. 4,884,719), Chang (U.S. Pat. No. 4,876,136), Campbell (U.S. Pat. No. 4,747,782), Garbe, et al. (U.S. Pat. No. 4,725,495), Beal (U.S. Pat. No. 4,611, 611), and Morane (U.S. Pat. No. 4,471,874). These lip color or cosmetic samplers or applicators consist of the cosmetic material applied to a base of paper or other material. The cosmetic material is then transferred to the consumer's face from the paper base. The system may protect the consumer from bacterial or viral contamination, but they prevent multiple applications of different colored cosmetic material without having to clean the lips or other facial structures thoroughly between each application. Moreover, these systems require a much greater cost to the cosmetic producer. The cost of producing existing samples is considerably greater than producing the present invention. Also, the producer must make a great plurality of samples to provide all the colors in the producer's inventory. Also, there would be substantial waste as a majority of the samples will not be used, further increasing costs. It also would have to be individualized for each such producer, whereas the present invention is usable by any producer with minor modifications, such as the imprinting of a trademark or logo.

An object of the invention is to promote cosmetic sales to motivated prospective customers. In an example of using the prior art counter sampling methods, a prospective customer may apply a lip color sample and, not liking the color or shade, walk away without making a purchase. Under those circumstances another color or shade could not be tried on without having to wipe off the sampled lip color.

Needs exist for better and more economical color sampling methods.

SUMMARY OF THE INVENTION

The purpose of the invention is to prevent the direct application of lip color to the consumer's lips. It enables the consumer to visualize the color, shade and texture of the lip color material as if it had been so applied. She can then compare the color and texture of the lip color material next to her facial coloring. She can also compare several different colors of lip color during the same visit to a cosmetic counter. After a series of viewings, eliminating colors or shade and narrowing candidate colors and shades, a purchase and a satisfied cosmetic customer are highly probable.

The invention is a section of transparent flexible material that has a pair of lips depicted upon it. The consumer may then apply a standard lip color by lipstick, brush, pencil or other applicator to the depicted lips on this screen of transparent material. She can then place it in front of her lips, assess the color, shade and texture of the lip color material and compare it to her own complexion as seen through the transparent material.

In another preferred embodiment, a section of transparent material is placed over a depiction of a pair of lips on a separate template. The consumer may then apply a standard lip color by lipstick, brush, pencil or other applicator to the screen of transparent material using the underlying template as a guide for the lip's shape. She may then place the screen of transparent material, now having the lip color sample in the shape of a pair of lips, in front of her own lips. She may then assess the color, shade and texture of the lipstick material and compare it to her own complexion, as seen through the transparent material.

The depiction of the lips printed on the screen or on the separate template sheet may be the shape of the lips colored in a natural or other hue. It may also be an outline only of a pair of lips similarly printed on the material in black, gray or other color that is clearly visible through the overlying transparent screen.

Another variation is an outline of a pair of lips with a dull matte outline without ink on the transparent sheet.

In another embodiment, the shape of the lips are in a dull or matte shape on a clear background. In this embodiment, there would be no ink used. The lips are a dull surface permitting lip color to better adhere with a clear shiny background. The dull surface lips shape also provides for easier application of lip color.

In another embodiment, the lips shape is impressed in the clear transparent material so that the lips may then fit to the contour of the consumer's lips. The impressed lips shape may also be colored or depicted as noted above.

The lip shape may be any combination of colored ink, dull matte finish or outline in colored ink, black, gray or dull matte fine. It may be raised or flat, or any combination thereof Another embodiment is that at manufacture the lip color is directly applied to a transparent sheet in the shape of a pair of lips and coated with a clear sealant to prevent the lip color from smearing. The consumer holds the transparent sheet with lip color in front of her lips. The consumer may see her own shading through the transparent sheet to assess how the lip color will look once applied. The sealant coating may be a thin transparent plastic sheet or a sprayed or otherwise deposited settable clear coating. Preferably, the sealant is not glossy, so that the true color, shade and sheen of the lip color may be seen when holding the transparent sheet in front of a user's lips.

Another embodiment is that the shade or hue of the lip color to be sold is printed on a transparent sheet in the shape of a pair of lips.

Another embodiment is that at manufacture the lip color is directly applied to a transparent sheet in the shape of a pair of lips and covered with another transparent sheet.

In these cases, the manufacturer may then distribute these sampling screens with previously applied lip color for trial by the consumer. It would permit distribution by mail or other means outside the usual sales counter.

The lip color sampling screens may be sheets stored in a box. The box can have an opening on one side for easy dispensing of the lip screens to be lifted out by the fingers. The lips screen sheets can be presented in a package of bound perforated detachable sheets. Another method of presentation is the lip screens in a continuous roll to be used in a roll dispenser. In the template version, the lip shape template may be attached to a dispenser such as described above, or may be attached to a tablet containing the transparent screens.

The present invention makes it possible for cosmetic manufacturers to increase sales by providing demonstration cosmetics at sales counters to avoid and overcome reluctance for sampling and demonstrating on the part of consumers. The cosmetics are applied to disposable plastic strips, screens or sheets within designated areas. After application of the colored cosmetics to the strips the strips are grasped, usually between fingers and thumb of the user. The strips may be held with tweezers or forceps or other means, all of which may be disposable. The cosmetic-colored strips are held in front of facial features of the user such as, for example, lips of the user, with the cosmetic coating, such as lip color, facing outward away from the user's face. The user then may view an image, such as reflected in a mirror, to see how the particular color of cosmetic suits the user's face and skin coloring. An evaluation may be made immediately. Several colors may be applied to successive strips, which can be held in front of the facial feature consecutively, discarding the strips with the least favorable colors and repeating the holding of the strips bearing more favorable colors in front of the facial feature until the most desirable colors are selected. The person may then purchase products having the selected colors immediately at the location and carry away the selected cosmetics without further delay and without further expense-generating commercial steps.

When choosing among several samples, for the convenience of the salesperson and customer, the strips bearing the colored cosmetics may be aligned directly in front of the containers of products with the colors. As colors are eliminated, the related strips are disposed of. The associated containers may be withdrawn. In that way the customer's selection process and purchase is speeded, without intervention of a salesperson.

Besides providing sanitary protection for the customer and sanitary protection for the expensive counter samples, the strips uniquely provide for the interchangeable and repeated sampling of many colors and shades at one visit to a cosmetic counter without having to remove and wipe away traces of the sampled colors, which is time consuming and bothersome.

Upon receiving brief instructions, a customer may apply the cosmetic to the strips within the designated areas and place the strips in front of the related sample containers. The customer may try many colors, shades and sheens and make repeated tries of the most promising ones without intervention of the cosmetician or clerk, which frees the worker for consultation with other and perhaps many customers at the same time. The economics of retail sales of cosmetics are thus greatly facilitated, both by reducing the amount of sample consumption and, more importantly, by reducing the time that the retail attendant is required to spend with each customer to make a sale. Thus the economics of selling cosmetics is greatly improved.

The outline has a particular advantage in that cosmetics, when applied indiscriminately, tend to have a negative effect on attractiveness. By providing precise outlines, the attractive characteristics of the cosmetics are enhanced when the cosmetics are held in front of a facial area of the user. Therefore the outlines are extremely important in providing the commercial benefits to the cosmetic industry, because the user will see an attractive appearance of color on her face.

In embodiments of the invention, the areas of application of the colored cosmetic may have a relatively roughened, embossed, etched, applied or matte finish. The non-smooth surface areas receive and hold the cosmetics for enhanced attractiveness while sampling various colors by holding cosmetic-coated strips in front of a facial area. The surface areas aid in preventing migration of the cosmetic from the desired areas on the strips during repeated handling of the strips, such as when choosing from several colors by successively eliminating the colors and repeatedly placing the same color in front of the facial area. That provides for increased economic benefit in the cosmetic industry by improving the appearance of the viewed image and increasing the sales potential of the cosmetics.

In some embodiments of the invention, the facial area depicted on the strip, such as lips, is preprinted with a natural facial area coloring, for example a natural lip appearance. The natural color may be uniform or applied in differing intensities to provide the appearance of natural lips. The value of the preprinted lip coloring is appreciated in two ways. First, during the application of the cosmetic to the area prior to holding in front of the face, the applied color in combination with the natural color provides the appearance that will be realized when the strip is held in front of the facial feature. Second, when the strip is held in front of the lips, the combined natural color and lip coloring material will provide an actual "as worn" appearance, irrespective of how far in front a facial feature the color-bearing screen is held.

A preferred lip color sampler apparatus has an elongated clear plastic strip having a life size outline of human lips printed thereon and having sufficient extension at ends of the outline of lips for allowing grasping by a finger and thumb of one hand. The strip has a clear, transparent surface at least within the outline of the lips for temporarily holding a coating of lip color applied from a commercial-type container of lip color. Application of lip color is accompanied by using a commercial-type applicator tube, pencil, brush or other means. Holding the strip over the lips of the user with the applied lip color coating facing outward away from the lips of the user enables multiple comparative sampling without adversely affecting the sample or the user's lips.

In one form of the invention, the clear plastic strip has an imprint of natural lip color on the surface of the strip. Receiving lip color from the sample applicator upon the natural lip color provides a realistic perception of the actual applied lip color on the lips of a user when the strip is held by a thumb and forefinger with the lip color coating facing outward away from lips of the user.

In one embodiment, an area of the strip inside the lip outline is opaque. In some embodiments, while the strip is transparent it is colored with a neutral lip tone.

The entire strip has a matte finish, or an area within the outline of the lips has a matte finish, and the remainder of the strip is clear and transparent.

In one embodiment, a box dispenses individual strips. Each strip remains in the box while a first strip is being dispensed. The dispensing of the first strip exposes a second strip for dispensing. An interior of the box may be treated with a bacteriostat material. The strips may be treated with a bacteriostat material.

A preferred cosmetic sampler has a self-sustaining, disposable, clear plastic sheet material having a finger-holding portion and a cosmetic-receiving portion, and a dispenser for the clear plastic sheet material. The cosmetic-receiving portion of the sheet material has a faint outline of a facial element. An area within the outline is configured for receiving cosmetic materials.

In a preferred embodiment, the faint outline is a faint outline of lips. Preferably the sheet material has a preprinted coloring of natural lips printed within the faint outline for receiving lipstick on the preprinted coloring of natural lips.

In one embodiment the outline comprises an outline depicting a feminine eye. In one embodiment, an area within or outside the outline has a matte finish for receiving eye area associated cosmetics. In another embodiment, eye openings are cut out such that the cosmetic color is applied near the eyes. In another embodiment, the transparent sheet has an outline of a face, such that cosmetics may be applied to the desired areas, such as cheeks, around eyes or other facial features.

The faint outline may be embossed or etched in the plastic sheet. The faint outline may be formed by a matte finish.

Preferably the dispenser is selected from the group of dispensers comprising a pop-out strip dispenser, a folded strip dispenser for dispensing strip elements one at a time, a continuous roll perforated strip dispenser for pulling and tearing strips from the roll, and a pad of dispenser strips for lifting strips from a top of the pad. The dispenser may be a package of loose strips.

A preferred method of sampling cosmetics includes removing a clear transparent strip having a depiction of a facial body feature from a grouping of similar strips, placing the strip on a flat surface and applying makeup from a commercial container with a commercial applicator. The applicator is selected from the group of applicators, including a tube, brush, sponge, pad and pencil. Grasping the clear plastic strip with the applied cosmetics by holding the strip on a peripheral portion thereof and positioning the strip with the applied cosmetics in front of a facial feature with the cosmetic-coated side of the strip away from a face of a user, the user views an image of her face with the cosmetic-coated area of the strip on front of a facial feature. Determining whether the color and shade of the cosmetic material which best suits the user's face is made according to the viewing.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
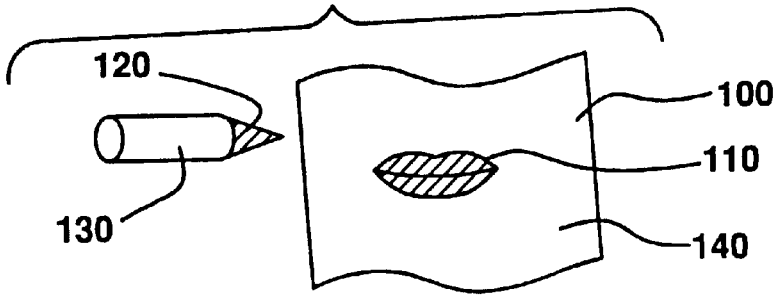
FIG. 1 is an illustration of the lip color being applied to a sampling screen.

Referring to FIG. 1, lip color sampling screen 100, made of cellophane or other transparent flexible material, possesses a depiction of a pair of lips 110 of natural shape and hue surrounded by transparent portion 140 of screen 100. Applicator 130 is used to apply lip color 120 to depiction of lips 110. Applicator 130 may be a lipstick, brush or other device normally used for this purpose.

Figure 2:
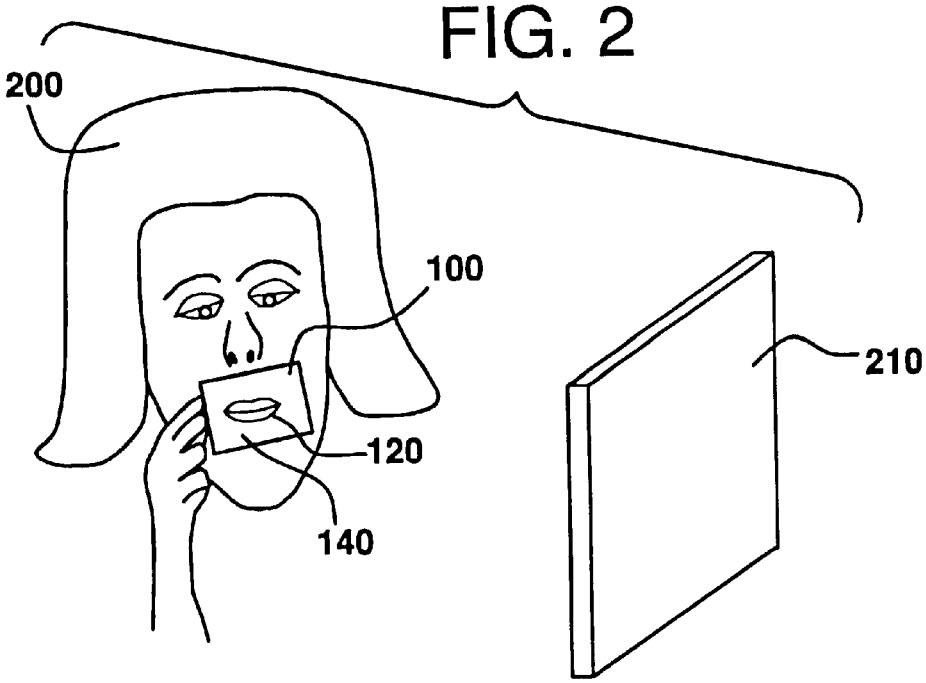
FIG. 2 is an illustration of a consumer using the lip color sampling screen.

FIG. 2 shows consumer 200 using lip color sampling screen 100 by holding it in front of her lips once lip color 120 has been applied. Consumer 200 then observes the appearance of the lip color 120 comparing it with her complexion through the transparent portion 140 of screen 100, using mirror 210.

Figure 3:
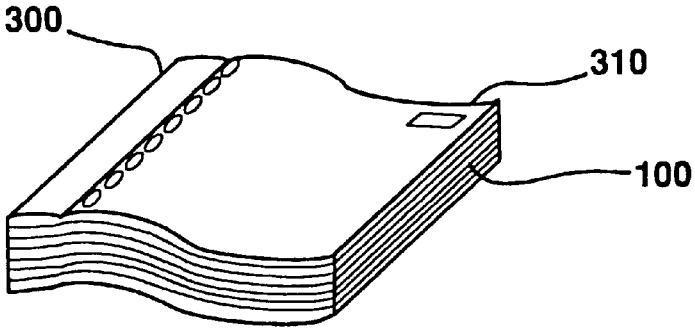
FIG. 3 is an illustration of a bound packet of lip color sampling screens.

FIG. 3 illustrates the lip color sampling screens 100 in bound packet 300 with a place for logo 310 in one corner of each screen.

Figure 4:
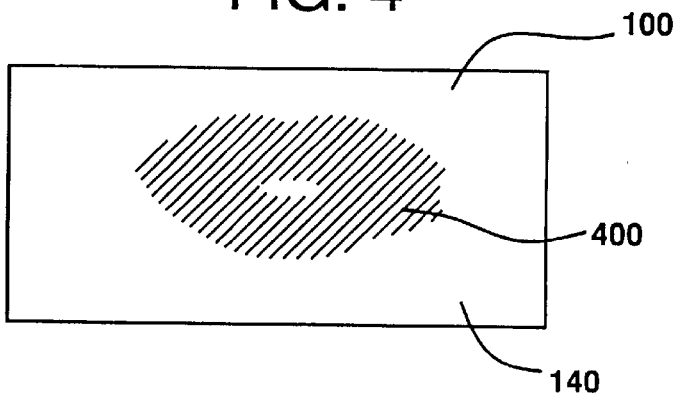
FIG. 4 is an illustration of the lip color sampling screen with matte lips.

FIG. 4 illustrates lip color sampling screen 100 with dull matte lips imprint 400 on clear transparent material 140.

Figure 5:
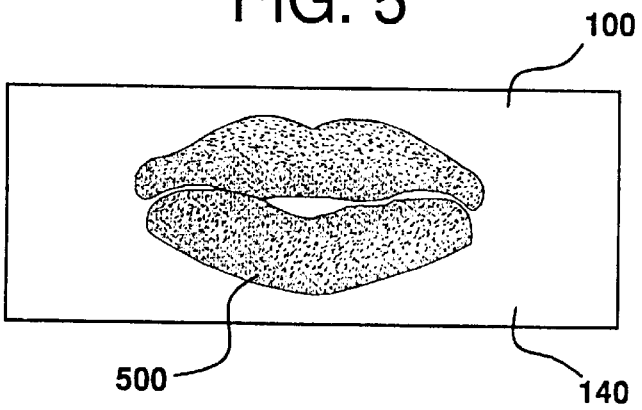
FIG. 5 shows a sample of the lip color sampling screen.

FIG. 5 illustrates printed lips 500 on lip color sampling screen 100 with transparent portion 140.

Figure 6:
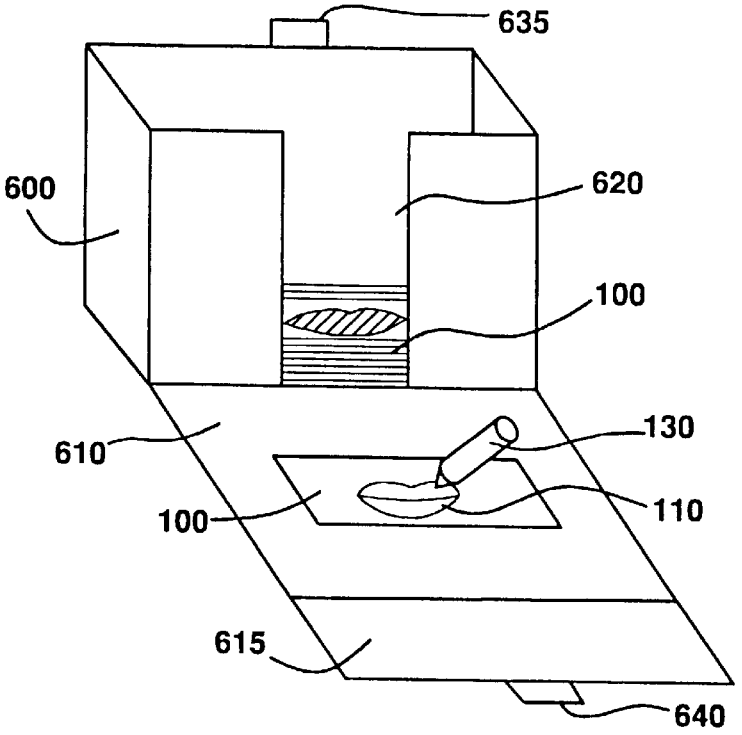
FIG. 6 is an illustration of a dispensing box for lip color sampling screens.

FIG. 6 is an illustration of dispensing box 600 that contains a plurality of lip color sampling screens 100. Cutout 620 allows access to easily take lip color sampling screens 100 out of dispensing box 600. Front cover 610 is hinged so that it may be laid down in order to easily apply lip color 120 with applicator 130 to lip color sampling screen 100 placed on front cover 610. Lid 615 is hinged to front cover 610 such that dispensing box 600 may be closed by attaching tab 635 to fastener 640.

Figure 7:
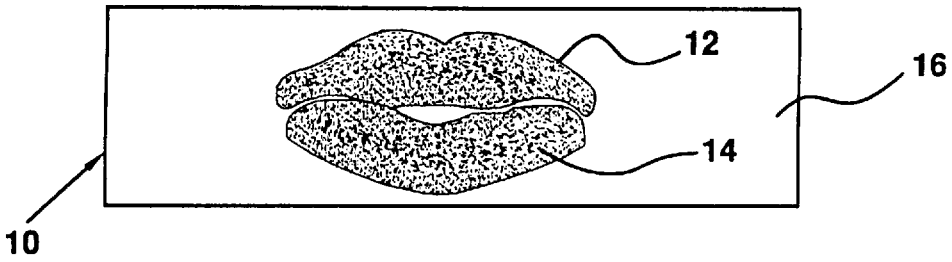
FIG. 7 shows a transparent strip with a naturally colored lip pre-preprinted thereon.

The strip 10 shown in FIG. 7 has a natural lip coloring 12 pre-printed thereon in a cosmetic receiving area 14. Gripping areas 16 are provided at opposite ends.

Figure 8:
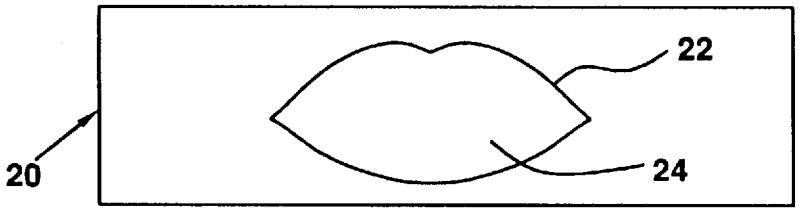
FIG. 8 shows a transparent strip with a lip outline with an interior matte finish for filling in with lipstick.

The strip 20 shown in FIG. 8 has a printed lip outline 22 with an interior area 24 in a matte finish to receive lipstick.

Any lipstick accidentally placed outside the outline may be removed easily with a tissue without disturbing the lipstick on the matte finished area 24. The strip 20 may be constructed with a matte finished area 24 without outline 22.

Figure 9:
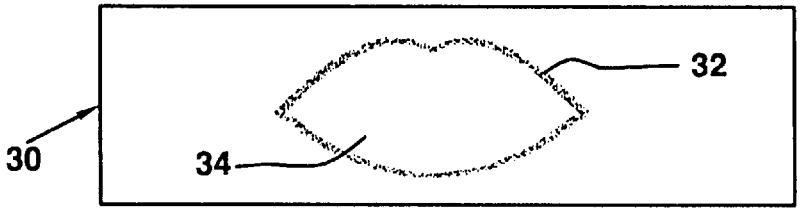
FIG. 9 shows a transparent strip with a light matte finished outline.

FIG. 9 shows a strip 30 with an outline 32 printed in a matte finish. The matte finish, for example, may be colored by a lip liner followed by application of lipstick in area 34 within the outline 32. The outline 32 and/or area 34 may be embossed or etched to receive lipstick.

Figure 10:
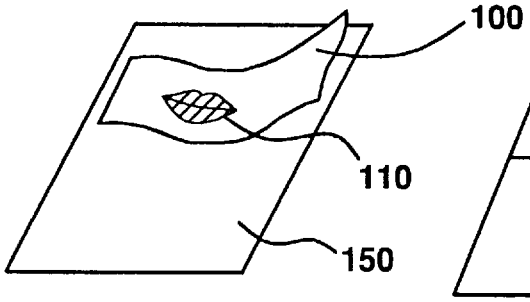
FIGS. 10 and 11 are an illustrations of the lip color sampling screens over templates.
Figure 11:
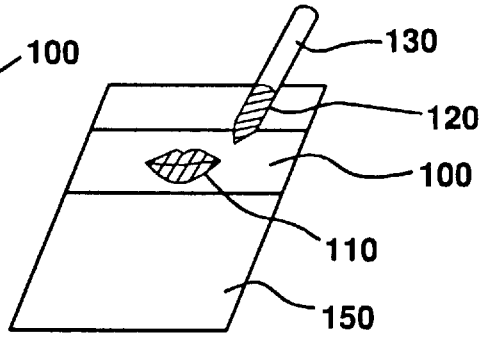

Referring to FIGS. 10 and 11, lip color sampling screen 100, made of cellophane or other transparent flexible material, is overlying a depiction of a pair of lips 110 of natural shape and hue on background template 150. Applicator 130 is used to apply lip color 120 to transparent screen 100 with depiction of lips 110 as a model on background template 150. Applicator 130 can be a lipstick, brush or other device normally used for this purpose.

Figure 12:
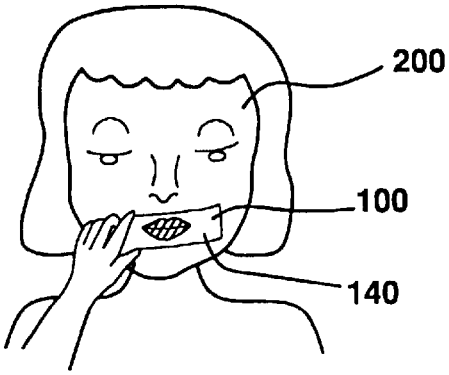
FIG. 12 is an illustration of a consumer using a lip color sampling screen of FIGS. 10 and 11.

FIG. 12 shows consumer 200 using lip color sampling screen 100 by holding it in front of her lips once lip color 120 has been applied. Consumer 200 then observes the appearance of the lip color 120 comparing it with her complexion through the transparent portion 140 of screen 100, using a mirror.

Figure 13:
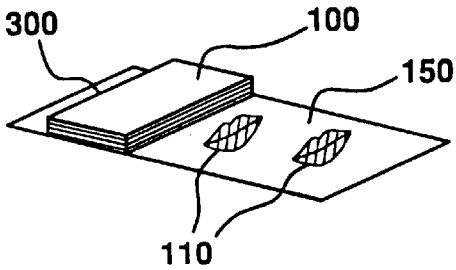
FIG. 13 is an illustration of a bound packet of lip color sampling screens and a template.

FIG. 13 illustrates the lip color sampling screens 100 in a bound packet 300. Background template 150 with lip depictions 110 of different sizes is attached to packet 300. Lip color sampling screen 100 may then be removed one by one for use by placing over lip depiction 110, as shown in FIG. 1.

Figure 14:
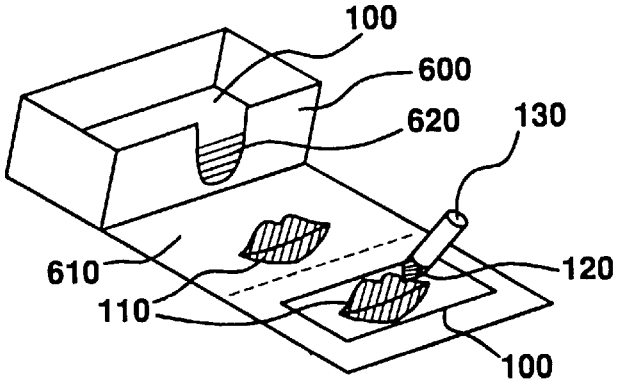
FIG. 14 is an illustration of a dispensing box for lip color sampling screens with the lip shape template.

FIG. 14 is an illustration of dispensing box 600 that contains a plurality of lip color sampling screens 100. Cutout 620 allows access to easily take lip color sampling screens 100 out of dispensing box 600. Front cover 610 is hinged so that it can be laid down in order to easily apply lip color 120 with applicator 130 to lip color sampling screen 100 placed on front cover 610. Background template 150 with lip depictions 110 of different sizes is on inside of front cover 610 to provide a model for application of lip color 120.

Figure 15:
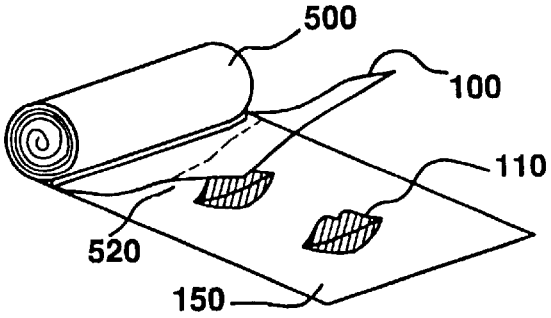
FIG. 15 is an illustration of a roll disposer with the lip shape template.

FIG. 15 is an illustration of roll dispenser 500 of lip color sampling screens 100 with perforations 520 for removal of individual lip color sampling screen 100. Background template 150 with lip depictions 110 of different sizes is attached to packet 300. Lip color sampling screen 100 can then be removed one by one for use by placing over lip depiction 110 as in FIGS. 10 and 11.

Figure 16:
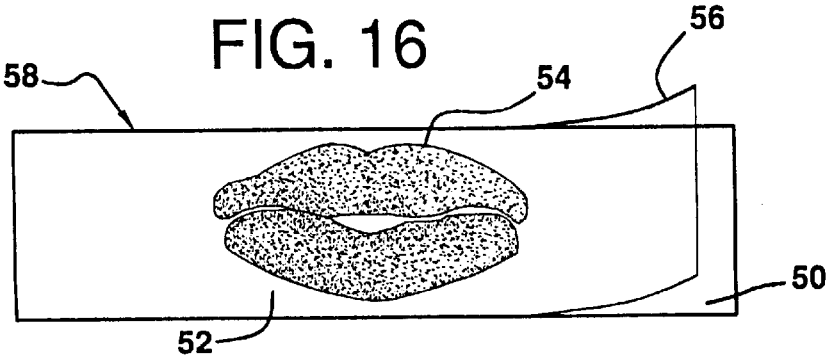
FIG. 16 illustrates a strip with a lip color cosmetic product applied in a cosmetic receiving area and a sealant coating being placed thereon.

FIG. 16 shows a disposable supporting transparent screen 50 with a lip color receiving portion 52 and a cosmetic product, namely lip color, 54. A protective transparent plastic film sealant 56 is applied to the screen over the lip color. The resultant sealed colored strip 58 is used as a disposable sampler by a customer when trying different shades and colors and is thrown away after used by the customer. The protective sealant 56 may be applied by spraying and drying, or by another coating method.

While the invention has been described with reference to specific embodiments, modifications and variations of the invention may be constructed without departing from the scope of the invention, which is defined in the following claims.

I claim:

1. Lip color sampler apparatus, comprising an elongated clear plastic strip having a life size outline of human lips printed thereon and having sufficient extension at ends of the lips for allowing grasping by a finger and thumb of one hand, the strip having a surface at least within the outline of the lips for temporarily holding a coating of lip color applied with a commercial-type applicator tube, brush sponge, pad pencil, and for holding the strip over lips of the user with the applied lip color coating facing outward away from the lips of the user, while viewing an image of the user.

2. The apparatus of claim 1, wherein the clear plastic strip has an imprint of the lip on the surface of the strip for receiving lip color from the sample applicator upon the imprint for providing a realistic perception of the actual applied color of the lip color on the face of a user when the strip is held by a thumb and forefinger with the lipstick coating facing outward away from lips of the user.

3. The apparatus of claim 2, wherein an area of the strip inside the lip outline is opaque.

4. The apparatus of claim 1, wherein the strip is transparent and an area inside the outline is colored with a neutral lip tone.

5. The apparatus of claim 1, wherein the entire strip has a matte finish.

6. The apparatus of claim 1, wherein an area within the outline of the lips has a matte finish, and the remainder of the strip is clear and transparent.

7. The apparatus of claim 1, further comprising a box for dispensing individual strips, wherein each strip remains in the box while a first strip is being dispensed, and wherein the dispensing of the first strip exposes a second strip for dispensing.

8. The apparatus of claim 7, wherein an interior of the box has anti-bacterial treatment.

9. The apparatus of claim 1, wherein the strip is treated with a bacteria static material.

10. A cosmetic sampler, comprising a self-sustaining, disposable, clear plastic sheet material strip having a finger-holding portion and a cosmetic-receiving portion, and a dispenser for the clear plastic sheet material strip.

11. The apparatus of claim 10, wherein the cosmetic-receiving portion of the sheet material strip has a faint outline of a facial element and an area within the outline configured for receiving cosmetic materials.

12. The apparatus of claim 11, wherein the faint outline is a faint outline of lips.

13. The apparatus of claim 12, wherein the sheet material has a coloring of natural lips printed on the sheet material strip within the faint outline for receiving lip color on the coloring of natural lips.

14. The apparatus of claim 11, wherein the outline comprises an outline depicting a feminine eye area, and wherein an area within the outline has a matte finish for receiving eye area associated cosmetics.

15. The apparatus of claim 11, wherein the faint outline is embossed in the plastic sheet.

16. The apparatus of claim 11, wherein the faint outline is formed by a matte finish.

17. The apparatus of claim 10, wherein the dispenser is selected from the group of dispensers comprising a pop-out strip dispenser, a folded strip dispenser for dispensing strip elements one at a time, a continuous roll of perforated strip dispenser for pulling and tearing strips from the roll, and a pad of dispenser strips for lifting strips from a top of the pad and a dispenser package of loose plastic strips.

18. The method of sampling cosmetics, comprising removing a clear transparent strip having a depiction of a facial body member from a grouping of similar strips, applying makeup within an outline on the clear plastic strip from a commercial container with a commercial applicator selected from the group of applicators, consisting of a tube, brush, sponge, pad and pencil on the clear plastic strip, grasping the clear plastic strip with the applied cosmetics by holding the strip on a peripheral portion thereof, positioning the strip with the applied cosmetics in front of a facial element with the cosmetic-coated side of the strip away from a face of a user, viewing an image of the user's face with the cosmetic-coated area of the strip on front of a facial feature of the user, and determining whether the color and shade of the cosmetic material suit the user's face, according to the viewing.

19. The method of claim 18, wherein the applying of makeup comprises applying lip color within a lip outline on the strip.

20. The method of claim 18, wherein the applying of makeup comprises applying makeup on a relatively roughened surface within the outline on the clear transparent strip.

21. The method of claim 18, comprising steps of placing the clear plastic strip on a template having a lip depiction, and forming the outline on the sheet using the lip depiction on the template as a guide before the applying of the make up within the outline.

22. The method of claim 18, further comprising coating the make up with a clear sealant after the applying of the make up.

23. The method of claim 22, wherein the clear sealant is a thin transparent sheet.

* * * * *